US010141634B2

(12) United States Patent
Xue et al.

(10) Patent No.: US 10,141,634 B2
(45) Date of Patent: Nov. 27, 2018

(54) ANTENNA FOR USE IN MOBILE TERMINAL

(71) Applicant: Beijing Xiaomi Mobile Software Co., Ltd., Beijing (CN)

(72) Inventors: Zonglin Xue, Beijing (CN); Linchuan Wang, Beijing (CN); Xiaofeng Xiong, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 20 days.

(21) Appl. No.: 15/407,346

(22) Filed: Jan. 17, 2017

(65) Prior Publication Data

US 2017/0222304 A1 Aug. 3, 2017

(30) Foreign Application Priority Data

Jan. 29, 2016 (CN) ..... 2016 1 0066990

(51) Int. Cl.

| | |
|---|---|
| ***H01Q 1/38*** | (2006.01) |
| ***H01Q 1/24*** | (2006.01) |
| ***H01Q 1/42*** | (2006.01) |
| ***H01Q 5/385*** | (2015.01) |

(52) U.S. Cl.

CPC ..... *H01Q 1/243* (2013.01); *H01Q 1/38* (2013.01); *H01Q 1/42* (2013.01); *H01Q 5/385* (2015.01)

(58) Field of Classification Search

CPC ..... H01Q 1/243; H01Q 5/385; H01Q 1/38; H01Q 1/42

USPC ..... 343/702

See application file for complete search history.

(56) References Cited

U.S. PATENT DOCUMENTS

2014/0306856 A1* 10/2014 Fan ..... H01Q 1/38 343/749
2014/0320349 A1 10/2014 Lee et al.
2014/0361929 A1 12/2014 Lin
2015/0070239 A1 3/2015 Hung et al.

(Continued)

FOREIGN PATENT DOCUMENTS

CN 102157779 A 8/2011
CN 102170043 A 8/2011
CN 202444054 U 9/2012

(Continued)

OTHER PUBLICATIONS

Extended Search Report for European Application No. 16204497.8 from the European Patent Office, dated Jun. 27, 2017.

(Continued)

*Primary Examiner* — Andrea Lindgren Baltzell
(74) *Attorney, Agent, or Firm* — Finnegan, Henderson, Farabow, Garrett & Dunner LLP

(57) ABSTRACT

An antenna for use in a mobile terminal includes a first radiation unit including a feed portion for inputting energy, the feed portion being provided at one end of the first radiation unit, and at least one coupling branch. The first radiation unit and the at least one coupling branch form a coupled feeding structure between each other. A first end portion of the at least one coupling branch is connected to a metal frame of the mobile terminal. The at least one coupling branch is disposed around the first radiation unit. The at least one coupling branch and the first radiation unit are not in contact with each other. The at least one coupling branch has an opening.

4 Claims, 3 Drawing Sheets

(56) References Cited

U.S. PATENT DOCUMENTS

2015/0123871 A1 5/2015 Chang et al.

FOREIGN PATENT DOCUMENTS

| | | | |
|---|---|---|---|
| CN | 103337697 | A | 10/2013 |
| CN | 203398265 | U | 1/2014 |
| CN | 104300213 | A | 1/2015 |
| CN | 104901000 | A | 9/2015 |
| EP | 3 062 388 | A1 | 8/2016 |
| WO | WO 2015/166345 | A2 | 11/2015 |

OTHER PUBLICATIONS

English version of International Search Report in International Application No. PCT/CN2016/100988, dated Dec. 23, 2016.
International Search Report in International Application No. PCT/CN2016/100988, dated Dec. 23, 2016.

* cited by examiner

ANTENNA FOR USE IN MOBILE TERMINAL

CROSS-REFERENCE TO RELATED APPLICATIONS

The present application is based upon and claims priority to Chinese Patent Application No. 201610066990.8, filed Jan. 29, 2016, the entire contents of which are incorporated herein by reference.

TECHNICAL FIELD

The present disclosure generally relates to communication technologies, and more particularly, to an antenna for use in a mobile terminal.

BACKGROUND

With the development of science and technology, mobile terminals have been very popular. Since requirements of performance of the mobile terminals are getting higher and higher, an antenna of the mobile terminals becomes an important feature that affects the performance of the mobile terminals.

The antenna of a mobile terminal may cause energy loss from an input port to a radiation end of the antenna. In related arts, a length of the antenna can be determined for a certain frequency band according to a resonant frequency. Thus, in a certain frequency band range, the energy loss from the input port to the radiation end of the antenna can be reduced.

SUMMARY

According to one aspect of the present disclosure, there is provided an antenna for use in a mobile terminal. The antenna includes a first radiation unit including a feed portion for inputting energy, the feed portion being provided at one end of the first radiation unit, and at least one coupling branch. The first radiation unit and the at least one coupling branch form a coupled feeding structure between each other. A first end portion of the at least one coupling branch is connected to a metal frame of the mobile terminal. The at least one coupling branch is disposed around the first radiation unit. The at least one coupling branch and the first radiation unit are not in contact with each other. The at least one coupling branch has an opening.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

The present disclosure utilizes a coupling feed method. By adjusting a structure of a first radiation unit, a structure of at least one coupling branch, a relative position of the first radiation element to the at least one coupling branch of an antenna, energy loss from an input port to a radiation end of the antenna in a wide frequency band can be reduced.

Technical solutions of the present disclosure will be made in detail with reference to specific embodiments. The following embodiments may be combined with each other, and the same or similar concepts or processes will not be elaborated in some embodiments.

Figure 1:
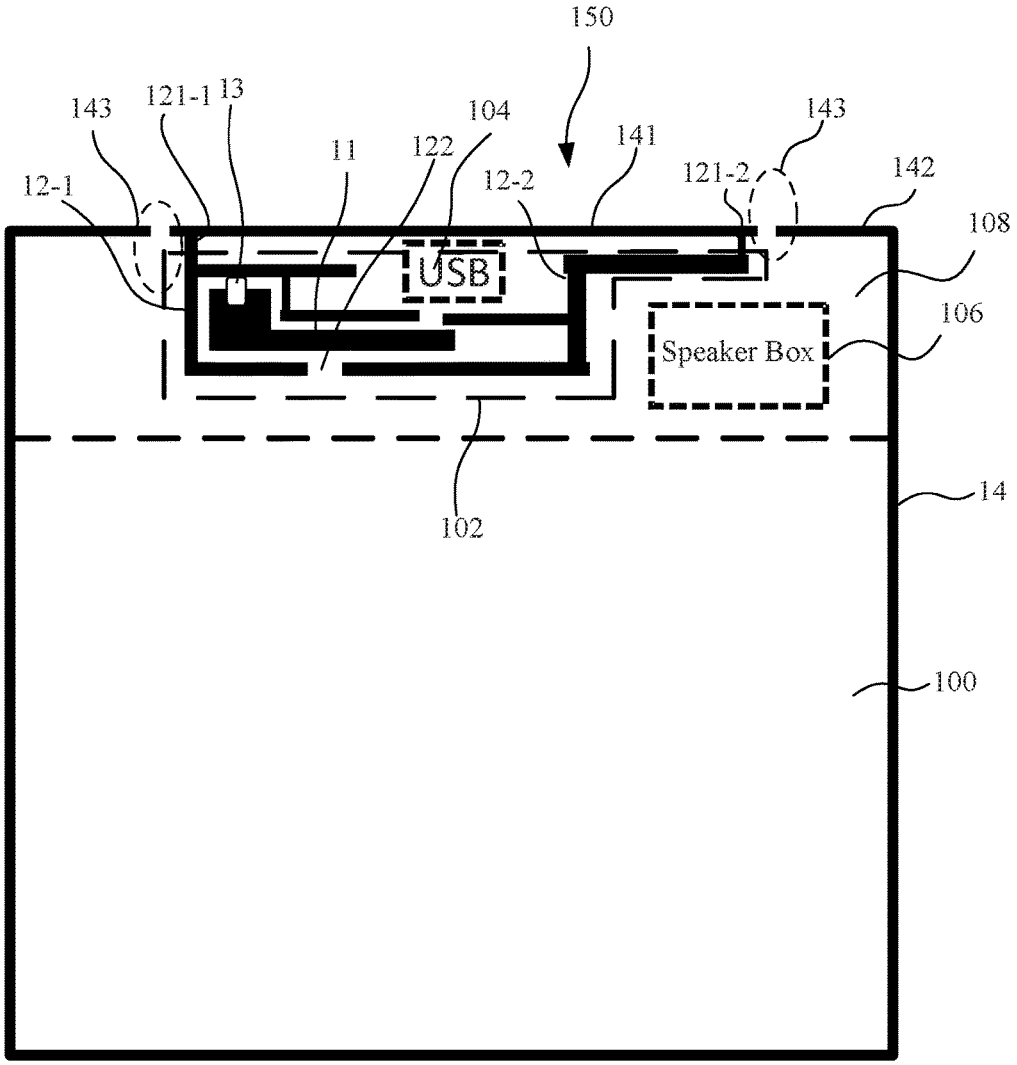
FIG. 1 is a schematic diagram of a mobile terminal including of an antenna according to an exemplary embodiment.

FIG. 1 is a schematic diagram of an antenna 102 of a mobile terminal 100 according to an exemplary embodiment. As shown in FIG. 1, the mobile terminal 100 includes, for example, the antenna 102, a Universal Serial Bus (USB) port 104, and a speaker box 106 provided on a printed circuit board (PCB) 108. The antenna 102 of the present embodiment includes: a first radiation unit 11 and at least one coupling branch 12 (two coupling branches 12-1 and 12-2 are shown in FIG. 1 as an example). The first radiation unit 11 and at least one coupling branch 12 can form a coupled feeding structure between each other. A feed portion 13 used for inputting energy is provided at one end portion of the first radiation unit 11. One end 121 of the at least one coupling branch 12 is connected with a section 141 of a metal frame 14 of the mobile terminal 100. The at least one coupling branch 12 is disposed around the first radiation unit 11. The at least one coupling branch 12 and the first radiation unit 11 do not contact with each other. The at least one coupling branch 12 is disposed to partially surround the first radiation unit 11 to realize the coupling effect. The at least one coupling branch 12 has an opening 122 for keeping a distance from other components of the mobile terminal 100.

FIG. 1 illustrates an exemplary structure of the first radiation unit 11, which can also be a strip shape, an L shape, an F shape, and the like. The embodiments of the present disclosure do not impose limitations on the structure of the first radiation unit 11.

FIG. 1 also illustrates an exemplary structure of the coupling branch 12. Other structure of the coupling branch 12 can be employed as long as the coupling branch 12 does not contact with and is disposed around the first radiation unit 11. The structure of the coupling branch 12 may also have various modifications, such as in a strip shape, an L shape, an F shape, and the like, and the embodiments of the present disclosure does not impose limitations on the structure of the coupling branch 12.

In the present embodiment, the feed portion 13 used for inputting energy is provided at one end portion of the first radiation unit 12. One end 121 of the at least one coupling branch 12 is connected to the metal frame 14 of the mobile terminal 102. The at least one coupling branch 12 is disposed around the first radiation unit 11. The at least one coupling branch 12 and the first radiation unit 11 do not contact each other. The at least one coupling branch 12 has an opening. The first radiation unit 11 and the at least one coupling branch 12 can form a coupled feeding mechanism with each other. By utilizing coupling feed and adjusting the structure of the first radiation unit 11, the structure of the at least one coupling branch 12, the relative position between the first radiation unit 11 to the at least one coupling branch 12, the antenna 100 can have a frequency band of 700 MHz to 3000 MHz, such that energy loss from an input port, i.e., the feed portion 13, to a radiation end of the antenna 100 can be reduced. For example, a radiation end of the antenna 100 is formed between an edge of the first radiation unit 11 and the at least one coupling branch 12.

Referring again to FIG. 1, one end 121-1 of a first one 12-1 of the two coupling branches 12 and one end 121-2 of a second one 12-2 of the two coupling branches 12 are connected to two end portions of the first segment 141 of the metal frame 14, respectively. Slits 143 are respectively provided at the two ends of the first segment 141 of the metal frame 14 so as to isolate or separate the first segment 141 from the other segment 142 of the metal frame 14.

The first segment 141 of the metal frame 14 is provided on a first side 150 of the metal frame 14. The first side 150 is a narrow side of four sides of the metal frame 14.

In the present embodiment, one end 121-1 of one of the two coupling branches 12 and one end 121-2 of the other one of the two coupling branches 12 are respectively connected to two ends of the first segment 141 of the metal frame 14. The slits 143 are provided between each of the two ends of the first segment 141 of the metal frame 14 and the other segment 142 of the metal frame 14. With the slits 143, the whole antenna 102 is connected to the first segment 141. When a user uses the mobile terminal 100, the interference from a hand or hands of the user to the antenna 102 can be reduced.

Figure 2:
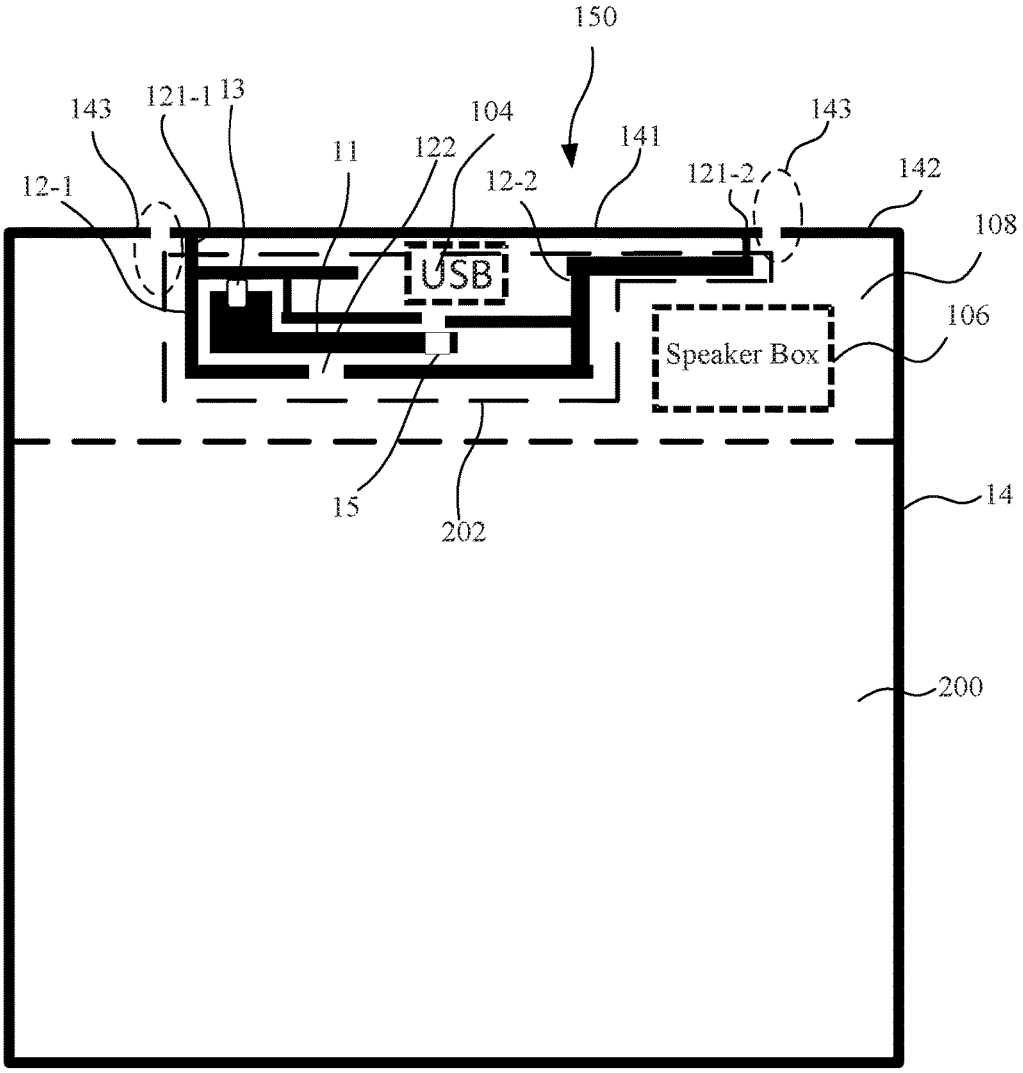
FIG. 2 is a schematic diagram of another mobile terminal including of an antenna according to an exemplary embodiment.

FIG. 2 is a schematic diagram of an antenna 202 of a mobile terminal 200 according to another exemplary embodiment. The embodiment shown in FIG. 2 is based on that shown in FIG. 1 such that the elements of the antenna 202 similar to those of antenna 102 are marked with same labels. As sown in FIG. 2, a ground point 15 connected to a ground level is provided at one end of the first radiation unit 11. When the ground point 15 is provided at one end of the first radiation unit 11, multiple resonant frequencies and their corresponding bandwidths covering an even wider frequency band can be obtained from tuning the antenna 202 by adjusting the structure of the first radiation unit, the structure of the at least one coupling branch, and the relative position between the first radiation unit to the at least one coupling branch are.

In the above embodiments, the first radiation unit 11 and the at least one coupling branch 12 are provided on the PCB 108 at a clear region to avoid being interfered by other components on the PCB 108, such as the USB port 104 or the speaker box 106.

In the above embodiments, the first radiation unit 11 and the at least one coupling branch 12 are provided at a predetermined region of the PCB 108 of the mobile terminal. The predetermined region of PCB is used to provide the antenna 102 or 202.

In some embodiments, the arrangement of devices, such as a speaker, a motor, and the like, other than the antenna on the PCB may flexible, and can be disposed on the left and right sides of the PCB close to metal frame regions, which have little effect on the performance of the antenna.

Figure 3:
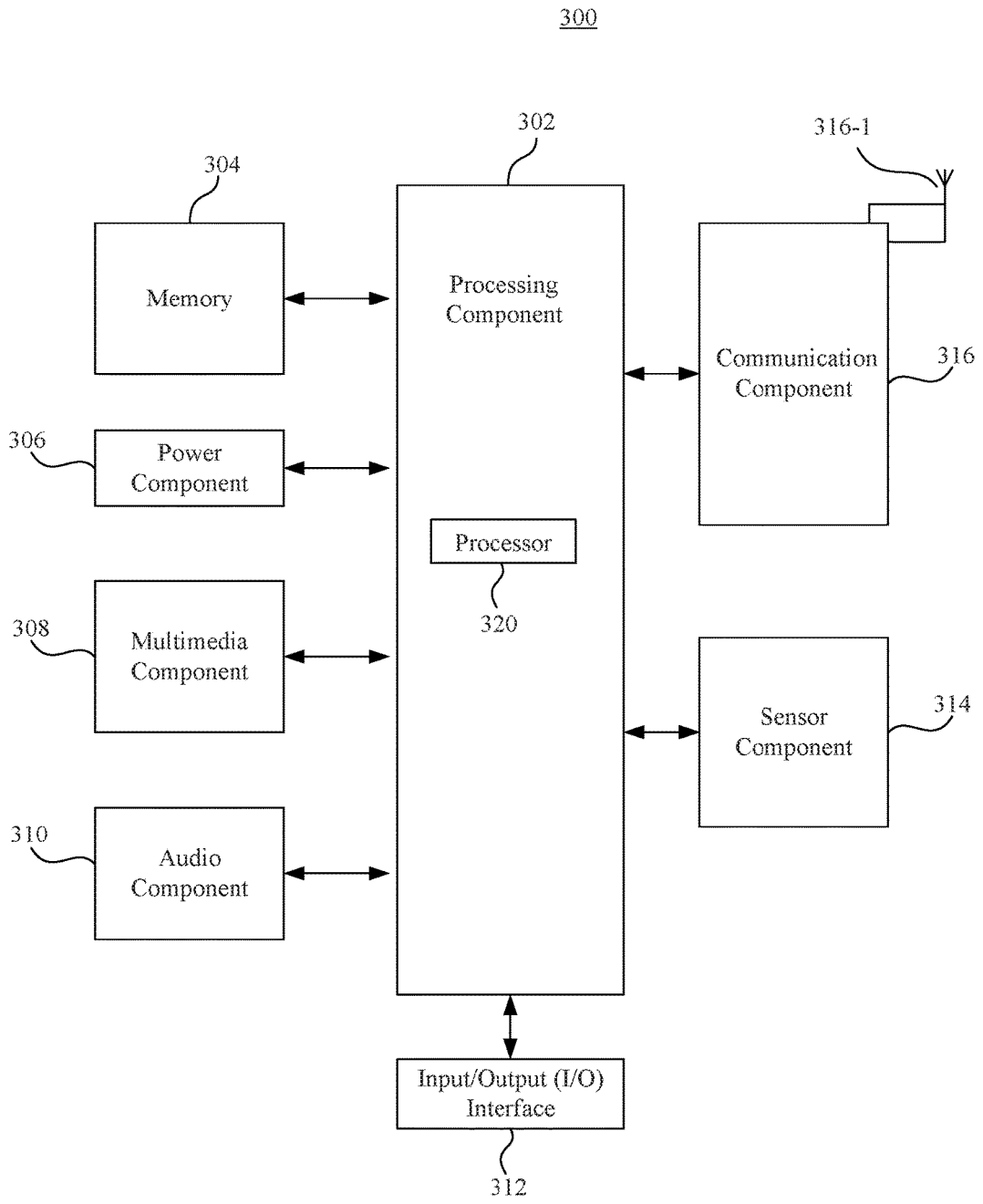
FIG. 3 is a block diagram of a mobile terminal according to an exemplary embodiment.

FIG. 3 is a block diagram of a mobile terminal 300 including one of the above antennas according to an exemplary embodiment. Referring to FIG. 3, the mobile terminal 300 may include one or more of the following components: a processing component 302, a memory 304, a power source component 306, a multimedia component 308, an audio component 310, an input/output (I/O) interface 312, a sensor component 314, and a communication component 316.

The processing component 302 typically controls overall operations of the mobile terminal 300, such as the operations associated with display, telephone calls, data communications, camera operations, and recording operations. The processing component 302 may include one or more processors 320 to execute instructions to perform all or part of the steps in the above described methods. Moreover, the processing component 302 may include one or more modules which facilitate the interaction between the processing component 302 and other components. For instance, the processing component 302 may include a multimedia module to facilitate the interaction between the multimedia component 308 and the processing component 302.

The memory 304 is configured to store various types of data to support the operation of the device 300. Examples of such data include instructions for any applications or methods operated on the mobile terminal 300, contact data, phonebook data, messages, pictures, video, etc. The memory 304 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 306 provides power to various components of the mobile terminal 300. The power component 306 may include a power management system, one or more power sources, and any other components associated with the generation, management, and distribution of power in the mobile terminal 300.

The multimedia component 308 includes a screen providing an output interface between the mobile terminal 300 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 308 includes a front camera and/or a rear camera. The front camera and the rear camera may receive an external multimedia datum while the device 300 is in an operation mode, such as a photographing mode or a video mode. Each of the front camera and the rear camera may be a fixed optical lens system or have focus and optical zoom capability.

The audio component 310 is configured to output and/or input audio signals. For example, the audio component 310 includes a microphone configured to receive an external audio signal when the mobile terminal 300 is in an operation mode, such as a call mode, a recording mode, and a voice recognition mode. The received audio signal may be further stored in the memory 304 or transmitted via the communication component 316. In some embodiments, the audio component 310 further includes a speaker to output audio signals.

The I/O interface 312 provides an interface between the processing component 302 and peripheral interface modules, such as a keyboard, a click wheel, buttons, and the like. The buttons may include, but are not limited to, a home button, a volume button, a starting button, and a locking button.

The sensor component 314 includes one or more sensors to provide status assessments of various aspects of the mobile terminal 300. For instance, the sensor component 314 may detect an open/closed status of the device 300, relative positioning of components, e.g., the display and the keypad, of the mobile terminal 300, a change in position of the mobile terminal 300 or a component of the mobile terminal 300, a presence or absence of user contact with the mobile terminal 300, an orientation or an acceleration/deceleration of the mobile terminal 300, and a change in temperature of the mobile terminal 300. The sensor component 314 may include a proximity sensor configured to detect the presence of nearby objects without any physical contact. The sensor component 314 may also include a light sensor, such as a CMOS or CCD image sensor, for use in imaging applications. In some embodiments, the sensor component 314 may also include an accelerometer sensor, a gyroscope sensor, a magnetic sensor, a pressure sensor, or a temperature sensor.

The communication component 316 is configured to facilitate communication, wired or wirelessly, between the mobile terminal 300 and other devices. The mobile terminal 300 can access a wireless network based on a communication standard, such as WiFi, 2G, 3G or 4G or a combination thereof. In one exemplary embodiment, the communication component 316 receives a broadcast signal or broadcast associated information from an external broadcast management system via a broadcast channel. In one exemplary embodiment, the communication component 316 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies. The communication component 316 include an antenna 316-1 consistent with the above antenna 102 or 202 shown in FIGS. 1 and 2.

In exemplary embodiments, the mobile terminal 300 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer-readable storage medium including instructions, such as the memory 304 including instructions executable by the mobile terminal 300 including the antennas according to any of FIGS. 1 and 2. For example, the non-transitory computer-readable storage medium may be a ROM, a RAM, a CD-ROM, a magnetic tape, a floppy disc, an optical data storage device, and the like.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. An antenna for use in a mobile terminal, comprising:

a first radiation unit including a feed portion for inputting energy, the feed portion being provided at one end of the first radiation unit; and two coupling branches, wherein:

the first radiation unit and the two coupling branches form a coupled feeding structure;

one end of a first one of the two coupling branches and one end of a second one of the two coupling branches are respectively connected to two end portions of a first segment of a metal frame of the mobile terminal, the two coupling branches are disposed around the first radiation unit, the two coupling branches and the first radiation unit are not in contact with each other, and the two coupling branches define an opening; and first and second slits are respectively provided at two ends of the first segment of the metal frame to separate the first segment from other segments of the metal frame.

2. The antenna according to claim 1, wherein a second end portion of the first radiation unit is provided with a ground point.

3. The antenna according to claim 1, wherein the first segment of the metal frame is provided on a first side of the metal frame, and the first side is a narrow side of four sides of the metal frame.

4. The antenna according to claim 1, wherein the first radiation unit and the two coupling branches are provided in a clear region of a printed circuit board of the mobile terminal.

* * * * *